US007762398B2

(12) United States Patent
Tokie et al.

(10) Patent No.: US 7,762,398 B2
(45) Date of Patent: Jul. 27, 2010

(54) HANGER LABEL

(75) Inventors: Vicki L. Tokie, Scandia, MN (US); Jeffrey H. Tokie, Scandia, MN (US); Paul E. Gregory, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/054,046

(22) Filed: Mar. 24, 2008

(65) Prior Publication Data

US 2008/0296192 A1 Dec. 4, 2008

Related U.S. Application Data

(60) Provisional application No. 60/914,442, filed on Apr. 27, 2007.

(51) Int. Cl.
*B65D 85/00* (2006.01)
*A47H 1/10* (2006.01)
*B42F 13/00* (2006.01)

(52) U.S. Cl. ..... 206/459.5; 248/311.3; 248/339

(58) Field of Classification Search ..... 248/DIG. 3, 248/690, 691, 683, 339, 317, 311.3, 205.3, 248/205.4; 40/661.9, 638, 310; 383/22, 383/23, 29, 14, 81; 220/751–756; 215/399, 215/DIG. 3, 12.1; 206/820, 459.5, 348; 283/81

See application file for complete search history.

(56) References Cited

U.S. PATENT DOCUMENTS 1,687,859 A * 10/1928 Fontaine ..... 206/806
2,479,700 A * 8/1949 Pritchard ..... 383/23
3,309,008 A * 3/1967 Huck ..... 383/22
3,862,687 A * 1/1975 Pirman ..... 206/806
4,003,538 A 1/1977 Frye
4,832,301 A * 5/1989 Hiramoto et al. ..... 248/691
5,048,676 A * 9/1991 Borgis et al. ..... 206/806
5,083,997 A * 1/1992 Wilkins et al. ..... 493/379
5,135,125 A 8/1992 Andel et al.
5,234,735 A * 8/1993 Baker et al. ..... 283/81
5,484,168 A 1/1996 Chigot
5,490,658 A 2/1996 Coward et al.
5,542,634 A 8/1996 Pomerantz
5,782,495 A 7/1998 Grosskopf et al.
5,863,628 A * 1/1999 Barry ..... 283/81
5,975,582 A 11/1999 Treleaven
6,073,758 A * 6/2000 Webster et al. ..... 206/806
6,082,777 A 7/2000 Grosskopf et al.

(Continued)

FOREIGN PATENT DOCUMENTS

JP 2003-066848 3/2003

(Continued)

OTHER PUBLICATIONS

Napco, Hang Tabs Catalogue, www.napcomfg.com.

*Primary Examiner*—Ehud Gartenberg
*Assistant Examiner*—Kaushikkumar Desai

(57) ABSTRACT

Hanger labels that include a first label segment, a second label segment, and a hanger are described. The hanger may include a hook, a first connection connecting the hook to the first label segment, and a second connection connecting the hook to the second label segment. Alternatively, the hanger may include a strap connecting first and second label segments. Containers including such hanger labels are also described.

14 Claims, 7 Drawing Sheets

U.S. PATENT DOCUMENTS

| | | | | |
|---|---|---|---|---|
| 6,110,553 | A | 8/2000 | Grosskopf et al. | |
| 6,272,780 | B1 | 8/2001 | Satamian | |
| 6,329,034 | B1 | 12/2001 | Pendry et al. | |
| 6,349,974 | B1 | 2/2002 | Grosskopf et al. | |
| 6,432,500 | B1 * | 8/2002 | Jones et al. | 283/81 |
| 6,517,038 | B1 * | 2/2003 | Pomerantz | 248/214 |
| 6,769,541 | B1 * | 8/2004 | Carriere | 248/683 |
| 6,910,575 | B2 * | 6/2005 | Curtsinger et al. | 206/349 |
| 6,994,307 | B2 * | 2/2006 | Curtsinger et al. | 206/806 |
| 7,015,815 | B1 * | 3/2006 | Feibelman | 206/6.1 |
| 7,077,435 | B1 * | 7/2006 | Cowan | 283/81 |

FOREIGN PATENT DOCUMENTS

| | | |
|---|---|---|
| JP | 2004-233481 | 8/2004 |

* cited by examiner

HANGER LABEL

CROSS REFERENCE TO RELATED APPLICATION

This application claims the benefit of U.S. Provisional Patent Application No. 60/914,442, filed Apr. 27, 2007, the disclosure of which is incorporated by reference herein in its entirety.

FIELD

The present disclosure relates to labels that include a hanger. Such labels attached to product containers, including labels with indicia useful at various stages of the product life cycle, are also disclosed.

BACKGROUND

A wide variety of products are packaged in containers, e.g., bottles, cans, and boxes. The particular design of a container depends on many factors including the need to store the product in a convenient manner for shipping, display, and end use, as well as the desire to convey information about the product at various stages in the product's life cycle.

In some instances, information related to the product may be printed directly on the container. However, information is often printed on a label that is applied to the container. Various parts of the information included on such labels may be important throughout the life cycle of the product. For example, some information may be useful during shipping or while the product is on display at the point of purchase. Other information may be useful during the ultimate end use of the product. In some situations, the content and optimum orientation of the information may change depending, e.g., on the particular need for the information.

Just as the optimum orientation of information may change during a product's life cycle, the desired orientation and means of storing the container may differ as well. For example, one storage method may be desirable for shipping, a second for point of sale display, and a third for various end use applications.

Generally, there is a need for additional tools and methods for tailoring the display of product information and storing containers through out a product's life cycle.

SUMMARY

Briefly, in one aspect, the present disclosure provides a hanger label comprising a first label segment, a second label segment, and a hanger. In some embodiments, the hanger comprises a hook, a first connection extending from the first label segment to the hook, and a second connection extending from the second label segment to the hook. In some embodiments, the hook may include a hook element. In some embodiments, the hanger comprises a strap.

The first label segment comprises a first substrate having a first major surface and an opposite second major surface, and a first adhesive layer bonded to at least a portion of the second major surface of the first substrate. The second label segment comprises a second substrate having a first major surface and a second major surface, and a second adhesive layer bonded to at least a portion of the second major surface of the second substrate. When the hanger labels of the present disclosure are closed, at least a portion of the hanger is positioned between the first label segment the second label segment. In some embodiments, when the hanger label is closed, the entire hanger is covered by the second label segment.

In some embodiments, when the hanger label is closed, at least a portion of the second adhesive layer is adhered, e.g., releasably adhered, to the first major surface of the first substrate.

In some embodiments, the second label segment comprises a first portion of the second adhesive layer adhered to the first substrate defining a first edge of the second substrate, a second portion of the second adhesive layer adhered to the first substrate defining a second edge of the second substrate, and a center portion positioned between the first edge and the second edge. In some embodiments, the center portion is separated from the first edge by a first weakened line of the second substrate. In some embodiments, hanger labels of the present disclosure further comprise a protective layer adjacent the center portion of the second label segment.

In some embodiments, the hanger labels are integral hanger labels. In some embodiments, the hanger labels further comprise indicia on the first and/or the second label segment. Indicia may also be included on other surfaces of the hanger label including, e.g., one or more major surfaces of the protective layer, the first and second connection, and/or the hook.

In some embodiments, a hanger label may further comprise a protective layer, e.g., a fabric, extending from the first connection to the second connection. In some embodiments, the first and/or the second label segment further comprises a tab.

In another aspect, the present disclosure provides a labeled container comprising a container comprising a first exterior surface; and a hanger label according to the present disclosure adhered to the first exterior surface of the container.

In some embodiments, when the hanger label is in a closed position, the second label segment comprises a first portion of the second adhesive layer adhered to the first substrate defining a first edge of the second substrate, a second portion of the second adhesive layer adhered to the first substrate defining a second edge of the second substrate, and a center portion positioned between the first edge and the second edge. In some embodiments, when the hanger label is in a closed position, at least a portion of the second adhesive layer is adhered to the exterior surface of the container.

In some embodiments, the label is in an applied position such that the first adhesive layer is adhered to a first region of the exterior surface of the container, and the second adhesive layer is adhered to a second region of the exterior surface of the container. In some embodiments, the second label segment is bonded to the container with a repositionable bond.

The above summary of the present disclosure is not intended to describe each embodiment of the present invention. The details of one or more embodiments of the invention are also set forth in the description below. Other features, objects, and advantages of the invention will be apparent from the description and from the claims.

DETAILED DESCRIPTION

Figure 1A:
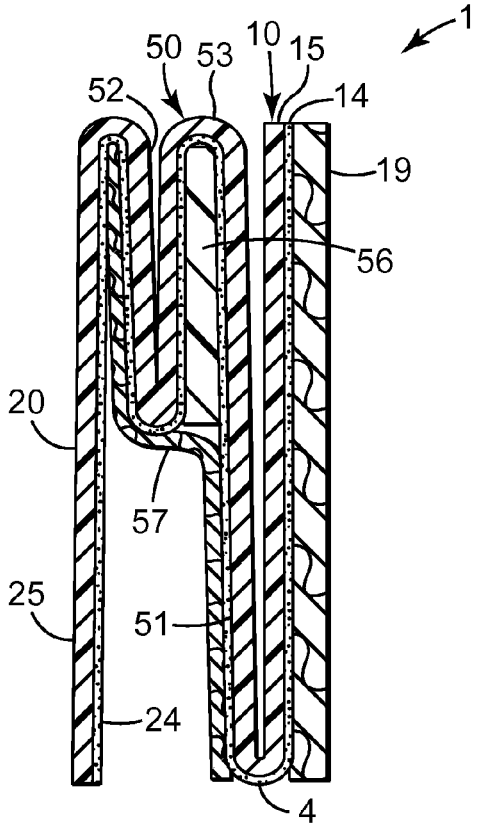
FIG. 1*a* illustrates a cross-sectional view of an exemplary hanger label according to some embodiments of the present disclosure.

Generally, the hanger labels of the present disclosure comprise a first label segment and a second label segment. The first label segment comprises a first substrate having a first major surface and an opposite second major surface, and a first adhesive layer bonded to at least a portion of the second major surface of the first substrate. The second label segment comprises a second substrate having a first major surface and a second major surface, and a second adhesive layer bonded to at least a portion of the second major surface of the second substrate.

Generally, any known substrates may be used, including, e.g., paper, polymeric films, metal foils (including, e.g., scrims, meshes, and screens), textiles (e.g., fabrics, and woven and non-woven substrates), multilayer substrates including laminates, and the like. Exemplary polymeric films include polyolefins, polyesters, polycarbonates, and polyimides. The substrates may be clear (e.g., optically clear), translucent, or opaque. The substrates may contain typical components such as fillers, dyes and pigments, and may be any color, including white and black. Each substrate may be independently selected. In some embodiments, the first and second substrates are the same.

In some embodiments, a conformable substrate may be used. As an aid to conformability, in some embodiments, thin substrates may be used, e.g., substrates having a thickness of less than about 2 millimeters (mm), e.g., less than about 1 mm, less than about 0.5 mm, less than about 0.1 mm, or even less than about 0.05 mm.

One or both major surfaces of the first and/or second substrate may be coated or uncoated. As used herein, the terms "coating" and "coated" refer to the presence of one or more additional layers on a surface, and are not intended to restrict the method by which such layers may be applied. Thus, coated substrates include, e.g., substrates having a layer applied by traditional methods such as roll coating, as well as other methods such as printing, spraying, extrusion, or lamination. Exemplary coatings include print receptive coatings, release coatings, and bonding layers including, e.g., primers.

Generally, a print receptive coating may be selected to improve the image quality achieved when printing indicia (e.g., letters, numerals, symbols, and graphics) on a substrate. Print receptive coatings may also be selected to improve the durability (e.g., scratch resistance) of printed indicia. Any known print receptive coating may be used including coatings comprising organic (e.g., resins) and/or inorganic (e.g., silica-containing) materials.

Generally, release coatings may be selected to reduce the force required to peel or otherwise remove a tacky layer (e.g., an adhesive layer) from contact with the underlying substrate. Any known release coating may be used. Typical release coatings comprise low surface energy materials such as silicones and fluorochemicals.

Bonding layers such as primer layers generally provide enhanced adhesion between adjacent layers. For example, a bonding layer may be located between a major surface of a substrate and e.g., a release layer or a print receptive layer. Also, a bonding layer may be located between an adhesive layer and a major surface of a substrate. As used herein, a specified layer is "directly bonded" to a substrate if that layer is in contact with a surface of a substrate, while a specified layer is "indirectly bonded" if one or more other layers, e.g., primer layers, are interposed between that specified layer and the surface of the substrate.

In some embodiments, a single coating may provide multiple benefits. For example, a single coating may provide both release characteristics and print receptive characteristics. That is, a single coating layer may function as both a release layer and a print receptive layer.

In some embodiments, a coating may cover substantially the entire surface of a substrate. In some embodiments, a coating may be applied to only specific regions of a substrate surface, e.g., a coating may be applied randomly, stochastically, at desired locations (e.g., the perimeter or center region of the surface) or in a defined pattern (e.g., dots, lines, including parallel lines and crosshatch patterns, and the like).

With respect to each of the various adhesive layers discussed herein, any known adhesive may be used, and each adhesive layer may be independently selected. Exemplary adhesives include pressure sensitive adhesives (PSA), hot melt adhesives, activatable adhesives (e.g., heat-activated or moisture-activated), and curable adhesives. Such adhesives are well-known and include rubber based adhesives such as, e.g., natural rubber and rubbers based on various combinations of styrene (S), isoprene (I), butadiene (B), and ethylene (E) (e.g., SIS, SBS, SI, SB, SEBS, and combinations thereof). Other typical adhesives include acrylics, urethanes, epoxies, silicones, and the like. Common additives such as plasticizers, tackifiers, fillers, foaming agents, dyes, pigments and the like may also be present, alone or in combination.

One or both adhesives may be selected to provide a substantially permanent bond or a removable bond. An adhesive provides a permanent bond between a substrate and a surface when the substrate cannot be removed without damaging the substrate, the surface, and/or the adhesive. A removable bond arises when the substrate can be removed without substantial damage. In some embodiments, the adhesive is cleanly removable. As used herein, a cleanly removable bond permits the label to be removed without substantial damage and with minimal adhesive residue remaining on the substrate to which the label was bonded. In some embodiments, a cleanly removable bond results in less than 5% adhesive residue, in some embodiments, less than 2%, less than 1%, and in some embodiments, substantially no adhesive residue.

In some embodiments, a removable bond may be a repositionable bond. A repositionable bond arises when the substrate and adhesive can be removed from a surface without substantial damage and rebonded in the same or at a different location with the desired bond strength.

The hanger labels of the present disclosure also comprise a hanger connecting the first label segment to the second label segment. When the hanger label is closed, at least a portion of the hanger is positioned between the first label segment and the second label segment. When the second label segment is pulled away from the first label segment and the hanger label is extended, the hanger is located between and connects the first label segment and the second label segment.

Figure 2:
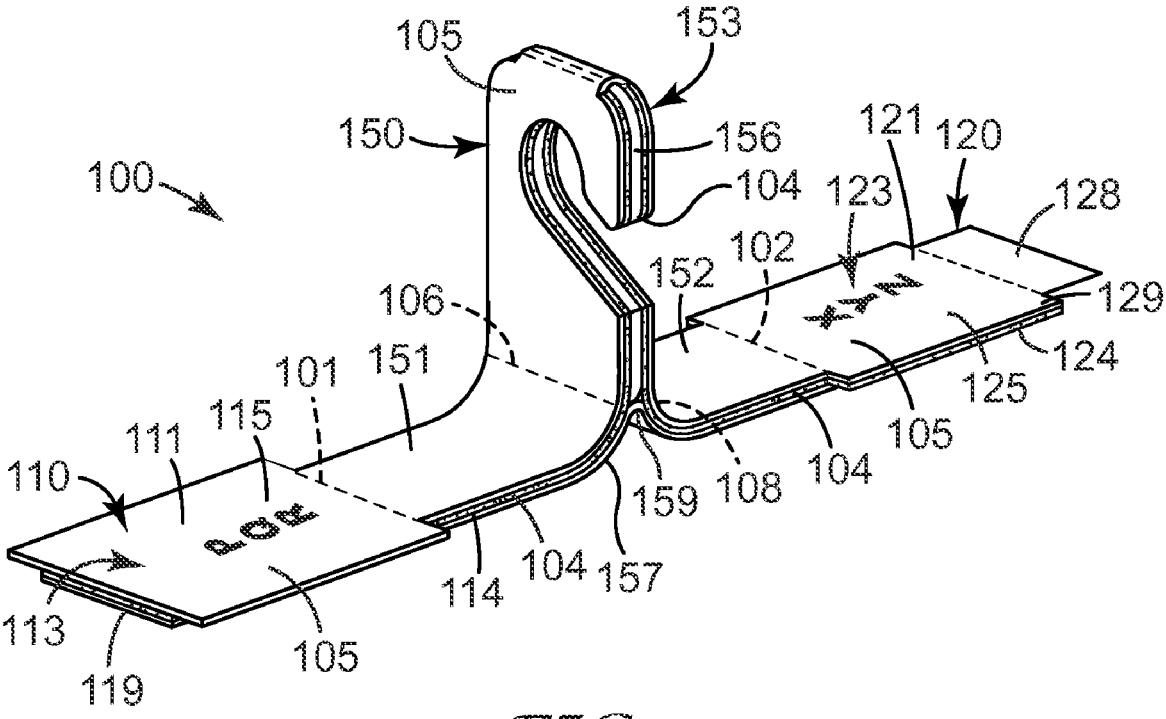
FIG. 2 illustrates an exemplary integral hanger label according to some embodiments of the present disclosure.

In some embodiments, the hanger comprises a hook, a first connection, and a second connection. The first connection connects the hook to the first label segment, while the second connection connects the hook to the second label segment. Generally, the terms hook, first connection, and second connection refer to the relative locations and functions of the various parts of the hanger. In some embodiments, the precise boundaries between the elements may be difficult to identify. For example, as shown in FIG. 2, all elements may comprise a common, continuous substrate.

Referring to FIGS. 1*a*-1*e*, a representative hanger label according to some embodiments of the present disclosure is illustrated. Referring to FIG. 1*a*, a cross-section of hanger label 1 is shown in a closed position. Hanger label 1 includes second label segment 20 including second substrate 25 and second adhesive layer 24; hanger 50, including first connection 51, second connection 52, and hook 53; and first label segment 10, including first substrate 15, and first adhesive layer 14. Release liner 19 covers first adhesive layer 14 to aid in storing and handling the hanger label prior to its application to a container.

Protective layer 57 covers the portion of adhesive layer 4 in the regions of first connection 51 and second connection 52. Generally, any known protective layer may be used including, e.g., paper, polymeric films, metal foils (including, e.g., scrims, meshes, and screens), textiles (e.g., fabrics, and woven and non-woven substrates), multilayer substrates including laminates, and the like; and/or coatings including organic resins, inorganic materials (e.g., silica or talc), and combinations thereof. In some embodiments, protective layer 57 may comprise a release liner. Release liners are well known, and typically comprise a substrate (e.g., a paper or film substrate) and a release material (e.g., a silicone or a fluorochemical) on one or both major surfaces of the substrate. In some embodiments, a release material may be located on the side of protective layer 57 adjacent second adhesive layer 24, allowing the second label segment to be pulled away from first connection 51 and second connection 52 as the hanger label is opened.

Figure 1B:
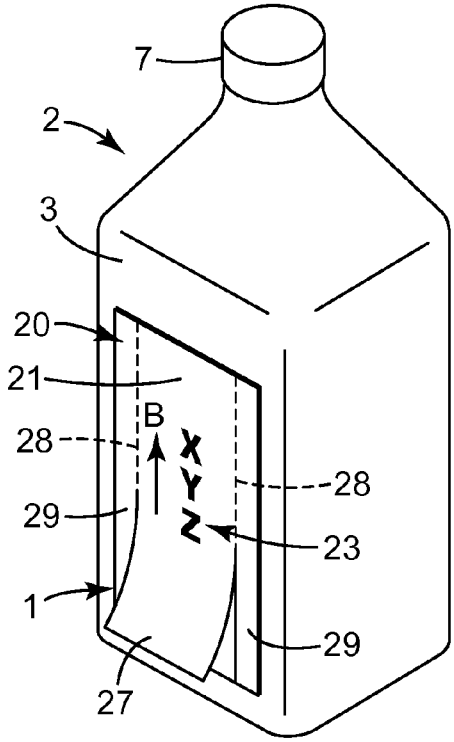
FIG. 1*b* illustrates the exemplary hanger label of FIG. 1*a* adhered to a container in a closed position.

Referring to FIG. 1*b*, the release liner has been removed from the first adhesive layer, and hanger label 1 is attached to first major surface 3 of container 2. In this position, second indicia 23 on first major surface 21 of second label segment 20 is visible. In some embodiments, it may be desirable to use an adhesive that provides a permanent bond to the container, e.g., to prevent tampering. For example, an adhesive may be selected to minimize or eliminate the risk that the label could be removed from the container with visible damage to the label. In some embodiments, removable, cleanly removable, or repositionable adhesives may also be desired.

Generally, the orientation of second indicia may be selected according to generally known design parameters. In some embodiments, the second indicia are oriented upright (see arrow B) relative to container 2 when the container itself is oriented upright (i.e., such that cap 7 is on top). This upright indicia orientation may provide information at various stages in the containers life cycle, e.g., during shipping, at the point of purchase, or during storage after purchase.

In the closed position, second label segment 20 is adhered along its edges 29 to the first label segment via the second adhesive layer. Center portion 27 of second label segment 20 may be released from the first label segment by lifting and tearing along weakened lines 28, which separate center portion 27 from edges 29. In some embodiments, the second label segment may include a tab or other similar element to aid in initiating the lifting and tearing process.

Generally, weakened lines 28 reduce the force required to separate center portion 27 from edges 29 and aid in controlling the boundary between the center portion and the edges. Exemplary weakened lines may include perforations and scores.

In some embodiments, the second adhesive layer may be releasably bonded to the first label segment. In such embodiments, the entire second label segment could be peeled from the first label segment without the need for weakened lines or edges. Releasable bonds are known in the art, and may be created by selecting the adhesion properties of the adhesive layer relative to the surface to which it is bonded.

In some embodiments, portions of the second adhesive layer may be bonded directly to the container rather than or in addition to the portions of the second adhesive that may be bonded to the first label segment. In some embodiments, the second adhesive will be releasably bonded to the container so that the second label segment may be removed from the container without damage when the hanger label is opened. In some embodiments, the portions of the second label segment that are bonded to the container may be separated from the unbonded portions of the second label segment by weakened lines. In such embodiments, as the hanger label is opened, the unbonded area may be lifted away from the container leaving the bonded portions adhered to the container.

Figure 1C:
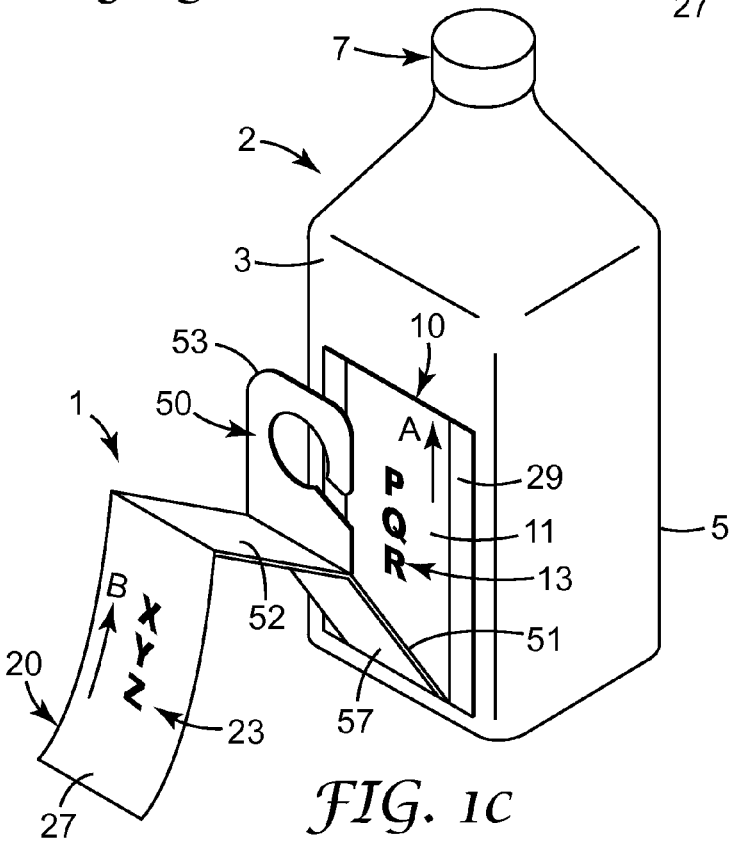
FIG. 1*c* illustrates the exemplary hanger label of FIG. 1*a* adhered to a container as the hanger label is opened.
Figure 1D:
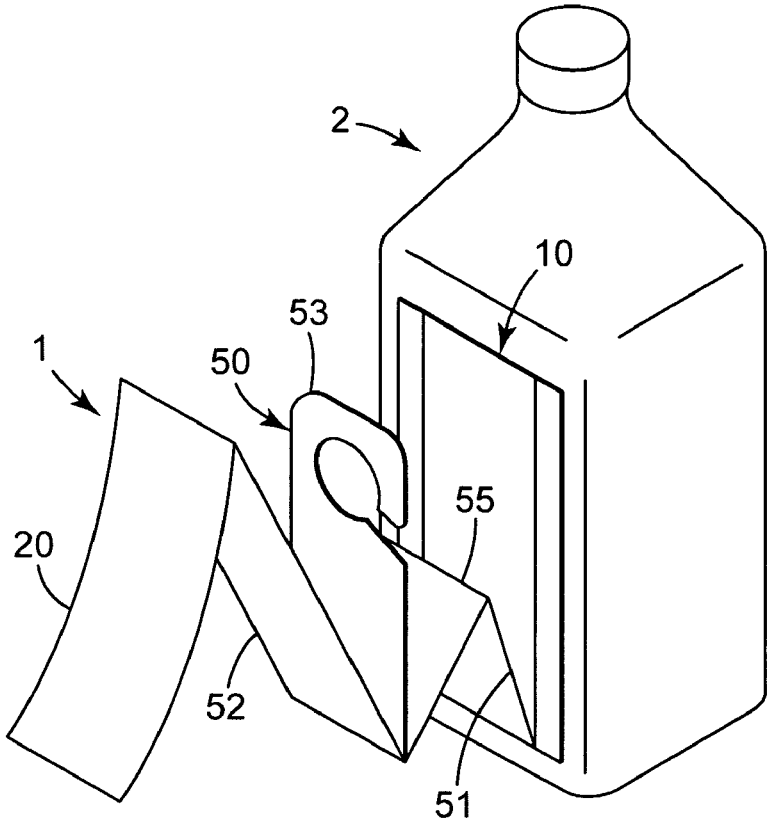
FIG. 1*d* illustrates another exemplary hanger label adhered to a container as the hanger label is opened.

Referring to FIG. 1*c*, as center portion 27 of second label segment 20 is pulled away from container 2 to open hanger label 1, hanger 50 and first major surface 11 of first label segment 10 are exposed. Hanger 50 includes first connection 51 connecting hook 53 with first label segment 10, and second connection 52 connecting hook 53 with second label segment 20.

Protective layer 57 spans first connection 51 and second connection 52. In the closed position, the second adhesive layer on center portion 27 of second label segment 20 was in contact with protective layer 57.

The orientation of optional first indicia 13 on first major surface 11 of first label segment 10 is upright with respect to container 2, as indicated by arrow A. Also, comparing arrows A and B, the first and second indicia were aligned (i.e., had a common orientation) when the label was in the closed position. Generally, the orientation of the first indicia may be rotated to any desired angle relative to the orientation of the second indicia. For example, the orientation of the first indicia may be inverted relative to the orientation of the second indicia. Also, the orientations of the first and second indicia relative to the container may be independently selected guided by, e.g., typical design considerations.

Referring again to FIG. 1*c*, in some embodiments, hook 53 is no greater than half the length of the second label segment. In some embodiments, the hook may be greater than half the length of the second label segment. Generally, the size of the hook may be selected to meet the needs of the application.

When the hook is longer than half the length of the second label segment, it may be desirable to modify the first and/or second connection. For example, referring to FIG. 1*d*, an alternative hanger label is shown where the hook is substantially equal to the length of the second label segment. In such embodiments, it may be desirable to include fold 55 in first connection 51. By including fold 55, when hanger label 1 is attached to container 2 in a closed position, all elements of hanger 50—including first connection 51, hook 53, and second connection 52—are positioned between first label segment 10 and second label segment 20. Thus, all of the elements of the hanger label are protected by second label segment 20 when the hanger label is closed.

In some embodiments, hooks longer than the second label segment may be used. In some embodiments, such hooks would extend beyond the perimeters of the second label segment. In some embodiments, the hook may be folded such that, in the closed position, the hook is fully covered by the overlying second label segment.

At some stage in the product's life cycle, it may be useful to alter the orientation of the container. For example, it may be desirable to invert the container such that the cap is located at the bottom. This inversion may create two problems. First, the container may be unstable if stored in an inverted position, e.g., balanced on its cap. Second, the indicia will also be inverted, which may make the information conveyed by the indicia difficult to read or understand.

Figure 1E:
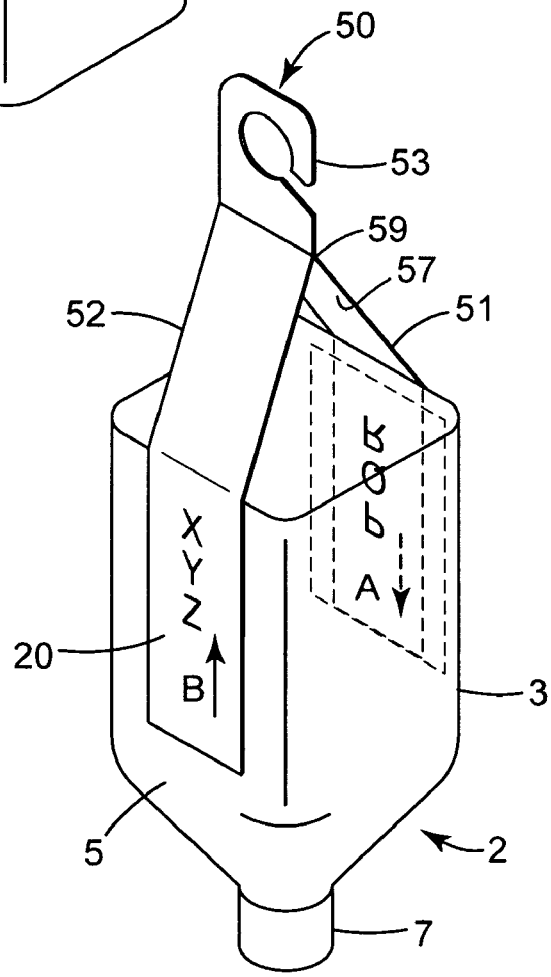
FIG. 1*e* illustrates the hanger label of FIG. 1*a* in an attached position.

Referring to FIG. 1*e*, container 2 has been inverted such that cap 7 is below the container. Second label segment 20 has been attached to second major surface 5 of container 2, such that hanger 50 is available to suspend container 2 in this inverted position via hook 53. In some embodiments, the container can be returned to its upright position and the label left in its attached position or returned to its closed position.

In some embodiments, the adhesive used to bond the second label segment to the container provides a repositionable bond. For example, in some embodiments, it may be desirable to remove the second label segment from the container and to refold and re-close the hanger label. At some later time, the hanger label could then be reused to suspend the container. Of course, in some embodiments, permanent, removable, or cleanly removable adhesive may also be desired.

Generally, the lengths of first connection 51 and second connection 52 may be independently selected to achieve a desired effect. In some embodiments, the first and second connections are long enough to permit the second label segment to be adhered at a desired location on second major surface 5 of the container. In some embodiments, the lengths of the connections are further selected to provide the desired distance between hook 53 and cap 7. In some embodiments, the relative lengths of the first and second connection are selected to provide the desired orientation of the suspended container.

In some embodiments, first and second connections may comprise the same substrates as, e.g., the first label segment, the second label segment, and/or the hook. In some embodiments, the substrates of the first and second label segments may be independently selected to provide desired attributes. For example, in some embodiments, it may be desirable to store the container upright (e.g., with the cap on top) after the hanger label is in its applied position (i.e., with both the first and second label segment adhered to the container). In such a situation, it may be desirable to use conformable materials to construct the first and second connections so that the hanger can be bent or twisted out of the way, permitting the container to be stored upright.

Referring again to FIG. 1*c*, second indicia 23 (see arrow B) were aligned with first indicia 13 (see arrow A) when the hanger label was closed. Referring to FIG. 1*e*, first indicia 13 are inverted (see arrow A) relative to second indicia 23 (see arrow B) when both the first and second label segment are applied to the container, (i.e., the "applied position"). In such embodiments, second indicia 23 may be upright and provide useful information when container 2 is inverted, while first indicia 13 would be inverted. In such embodiments, when container 2 is unhooked and stored in its upright position (i.e., with the cap on top), first indicia 13 would be upright and provide useful information, while second indicia 23 would be inverted.

In some embodiments, the first indicia may be inverted relative to the second indicia when the label is closed. In such embodiments, when the label is in the applied position and the container is inverted (i.e., with the cap down), both the first and second indicia would be upright. However, when the container is upright, both the first and the second indicia would be inverted. Of course, there are a vast number of other possible orientations of the first and second indicia, both relative to each other as well as relative to the container.

In the embodiments illustrated by FIGS. 1*a*-1*e*, at least a portion of the second label segment i.e., edge 29, was adhered to the first label segment when the hanger label was in a closed position; however, this is not required. For example, in some embodiments, when the hanger label is attached to a container in a closed position, both a portion of the first adhesive layer and a portion of the second adhesive layer may be bonded to the container itself. In such embodiments, the second label segment may be releasably attached to the container such that the second label segment may be lifted from the container and the hanger label is opened. In some embodiments, portions of the second label segment may be permanently bonded to the container. In such cases, the unbonded area of the second label segment may be separated from the bonded areas (e.g., edges) as the hanger label is opened.

In some embodiments, the hanger label may be a unitary hanger label. As used herein, a "unitary hanger label" is one in which all elements of the hanger label comprise a common substrate. Referring to FIG. 2, unitary hanger label 100 according to some embodiments of the present disclosure is shown. Hanger label 100 is similar to hanger label 1 of FIGS. 1*a*-1*e*; however, hanger label 100 is shown in an extended position for clarity.

Unitary hanger label 100 includes first label segment 110, hanger 150, and second label segment 120. Hanger 150 includes hook 153, first connection 151, and second connection 152. Each of these elements comprises portions of substrate 105, as well as portions of a common adhesive layer, i.e., adhesive layer 104.

First label segment 110 includes first portion 115 of substrate 105 and first portion 114 of adhesive layer 104. Release liner 119 is attached to adhesive layer 104 opposite substrate 105. The boundary between first label segment 110 and hanger 150 is defined by line 101, which generally corresponds to an edge of protective layer 157.

Similarly, second label segment 120 includes second portion 125 of substrate 105 and second portion 124 of adhesive layer 104. The boundary between second label segment and hanger 150 is defined by line 102, which generally corresponds to an edge of protective layer 157.

Second label segment 120 includes optional tab 128. In some embodiments, tab 128 comprises the portion of substrate 105 extending beyond adhesive layer 104. Generally, when the hanger label is in a closed position, a feature such as tab 128 can assist in initiating the removal of the second label segment. In some embodiments, the tab may comprise one or more additional layers positioned e.g., on the first major surface of the label segment, between layers of the label segment (e.g., between the second major surface and the adhesive layer), or adhered to the adhesive layer. In some embodiments, such a tab may extend from the one or more sides of label segment. In some embodiments, a tab may be formed at the edge of a label segment by pattern coating the adhesive, i.e., a selected portion of the second surface of the label substrate would be substantially free of adhesive. The location of the adhesive-free region of the label segment can be selected such that this portion is available to initiate the removal of the label segment.

Referring again to FIG. 2, in some embodiments, first indicia 113 may be associated with first major surface 111 of first label segment 110. Similarly, second indicia 123 may be associated with first major surface 121 of second label segment 120. Indicia may also be associated with other surfaces of the hanger label including, e.g., one or more major surfaces of the protective layer, the first and second connection, and/or the hook. As used herein, indicia are "associated with" a surface if the indicia are visible when viewing that surface. For example, in some embodiments, the indicia may be located directly on the first major surface. In some embodiments, the indicia may be located on an optional layer adjacent the first major surface. In some embodiments, one or more additional layers, e.g., protective coatings or films, may be located over the indicia, such that the indicia are visible when viewed through such additional layers.

Generally, protective layer 157 covers the portion of adhesive layer 104 in the regions of first connection 151 and second connection 152. Generally, any known protective layer may be used, including, e.g., those described herein with respect to protective layer 57 of FIGS. 1*a*-1*e*.

In some embodiments, protective layer 157 bridges gap 159 between first connection 151 and second connection 152. As shown in FIG. 2, gap 159 is located in the area where first connection 151 and second connection 152 first attach to hook element 156. In some embodiments, the gap is located in the region where the first connection and the second connection first join together to form a hook.

In some embodiments, the materials and location of the protective layer may be selected to enhance the performance of the hanger label. For example, referring to FIG. 1*e*, protective layer 57 bridges gap 59 between first connection 51 and second connection 52. Thus, when container 2 is suspended via hook 53, protective layer 57 prevents expansion of gap 59 between first connection 51 and 52. Such expansion may result in delamination and failure of hook 53. In some embodiments, it may be desirable to minimize the gap between the first and second substrates.

Referring again to FIG. 2, first connection 151 includes the portions of substrate 105 and adhesive layer 104 that extend from line 101 (which defines the boundary between first label segment 110 and first connection 151) to line 106 (which defines the boundary between first connection 151 and hook 153). Similarly, second connection 152 includes the portions of substrate 105 and adhesive layer 104 that extend from line 102 (which defines the boundary between second label segment 120 and second connection 152) to line 108 (which defines the boundary between second connection 152 and hook 153).

Hook 153 comprises the portions of substrate 105 and adhesive 104 that extend from line 106 to line 108. The location of the boundary between first connection 151 and hook 153 (i.e., the location of line 106) and the location of the boundary between second connection 152 and hook 153 (i.e., the location of line 108) are somewhat arbitrary. However, the precise location of these boundaries is not critical, and could be readily determined by one of ordinary skill in the relevant art.

For example, although not shown in FIG. 2, in some embodiments, the hook consists essentially of the portions of substrate 105 and adhesive 104 that extend between lines 106 and 108. Generally, the locations of lines 106 and 108 would correspond with the location where first connection 151 first contacts second connection 152 to begin forming hook 153.

In some embodiments, such as the embodiment shown in FIG. 2, hook 153 comprises hook element 156 as well as the portions of substrate 105 and adhesive 104 that are bonded to hook element 156. In such embodiments, the general location of lines 106 and 108 would correspond to the locations at which adhesive 104 first contacts hook element 156.

Generally, any known material may used to form hook element 156 including paper, polymeric materials (e.g., films), metals, foams, fabrics, and the like, as well as combinations thereof. Multilayer hooks, including laminates, may also be used. Exemplary laminates may include one or more relatively rigid layers and one or more relatively flexible layers. For example, in some embodiments, the hook may comprise a relatively flexible hook element, e.g., foam, between two relatively rigid skin layers. Alternatively, in some embodiments, the hook may comprise a relatively rigid hook element, e.g., polycarbonate, located between two relatively flexible skin layers. In some embodiments, the skin layers will comprise the substrate of the first and/or the second label segment.

As is well-known, the rigidity of a hook will depend on a variety of factors including the mechanical properties of the materials used to form the hanger, the thicknesses and orientations of the one or more layers of the hanger, and the design (e.g., the shape) of the hanger itself. One of ordinary skill in the relevant art is capable of selecting materials and designs for hooks to achieve a desired degree of rigidity or flexibility.

Parameters for selecting a particular hook material are well known and include the desired mechanical properties of the hook, compatibility with other materials in the hanger label, and cost.

Figure 3A:
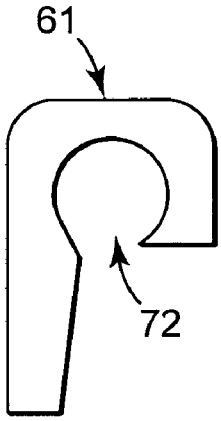
FIGS. 3*a*-3*c* illustrate various exemplary open hooks according to some embodiments of the present disclosure.
Figure 3B:
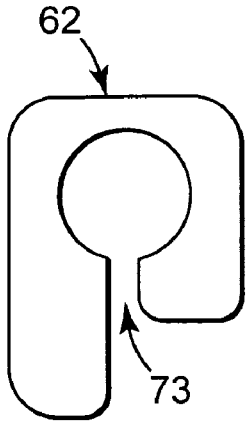
Figure 3C:
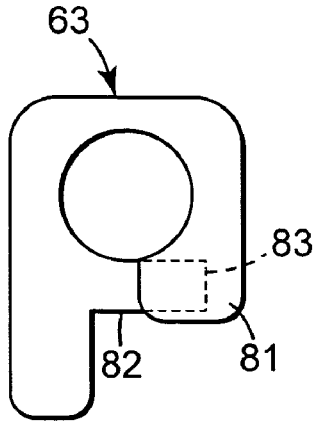

As shown in FIG. 2, in some embodiments, hook 153 is an open hook. Exemplary open hooks are also shown in FIGS. 3*a*-3*c*. As used herein, an "open hook" is one that can pass around a support (e.g., a rod or a bar) and suspend the article to which the hook is attached.

Figure 4A:
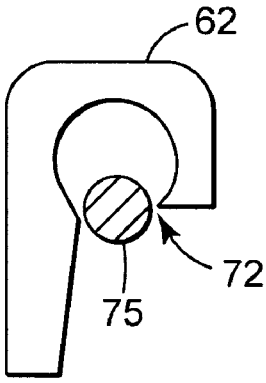
FIGS. 4*a*-4*c* illustrate the various exemplary open hooks of FIGS. 3*a*-3*c* engaged on a rod.
Figure 4B:
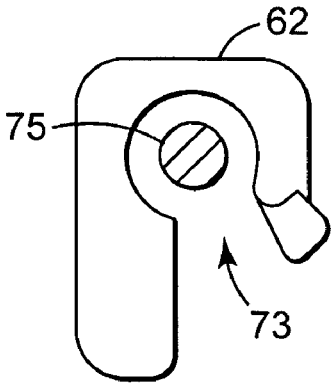
Figure 4C:
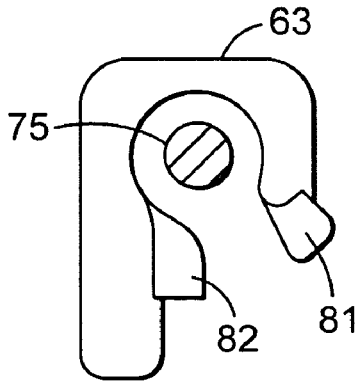

Open hooks include wide, narrow, and overlap hooks. Referring to FIGS. 3*a* and 4*a*, wide hook 61 has an opening 72 wide enough to pass around rod 75 without deforming. In contrast, referring to FIGS. 3*b* and 4*b*, opening 72 of narrow hook 62 must be deformed to pass around rod 75. Finally, referring to FIGS. 3*c* and 4*c*, overlap hook 63 must be deformed to pass around rod 75; however, unlike narrow hook 62, ends 81 and 82 overlap in region 83 when overlap hook 63 is in its undeformed state.

In some embodiments, ends 81 and 82 may be releasably attached to each other in region 83 by e.g., an adhesive or mechanical fastener. Such releasable attachment would allow overlap hook 63 to be opened to pass around rod 75, yet provide secure support when ends 81 and 82 were reattached to one another.

The terms "wide" and narrow" are relative and depend on the dimensions of the support with which the hook will be used. Generally, a wide hook would have an opening width of at least one centimeter, e.g., at least two centimeters, or even at least four centimeters. Typically, a narrow hook would have an opening width of less than one centimeter, e.g., less than 0.5 centimeters, or even less than 0.2 centimeters. As used herein, the opening width refers to the narrowest part of the opening.

Figure 5A:
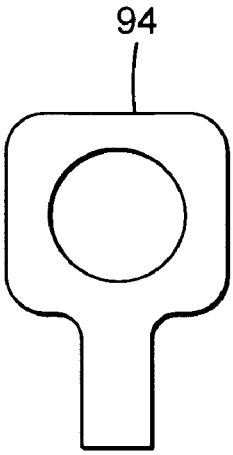
FIGS. 5*a*-5*c* illustrate various exemplary closed hooks according to some embodiments of the present disclosure.
Figure 5B:
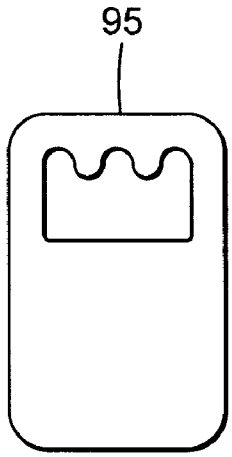
Figure 5C:
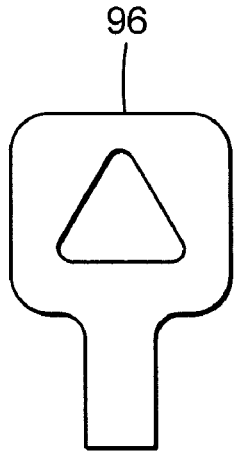
Figure 6:
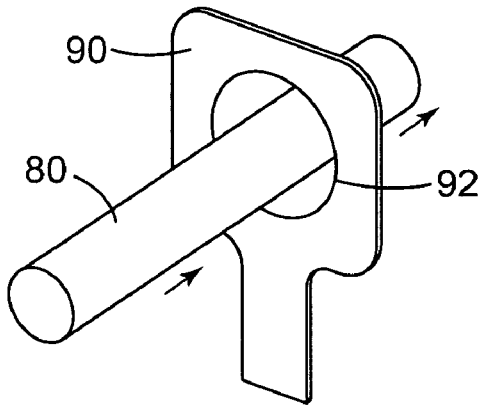
FIG. 6 illustrates one exemplary closed hook according to some embodiments of the present disclosure engaged on a rod.

In some embodiments, narrow and overlap hooks may be useful to prevent unintentional removal of the hook from the support. Closed hooks may also be used. Exemplary closed hooks 94, 95 and 96 are shown in FIGS. 5*a*-5*c*, respectively As shown in FIG. 6, a closed hook, such as closed hook 90, is one that can not pass around support 80, rather support 80 must pass through opening 92 of closed hook 90 so that the hook can support an article to which it is attached.

Figure 7:
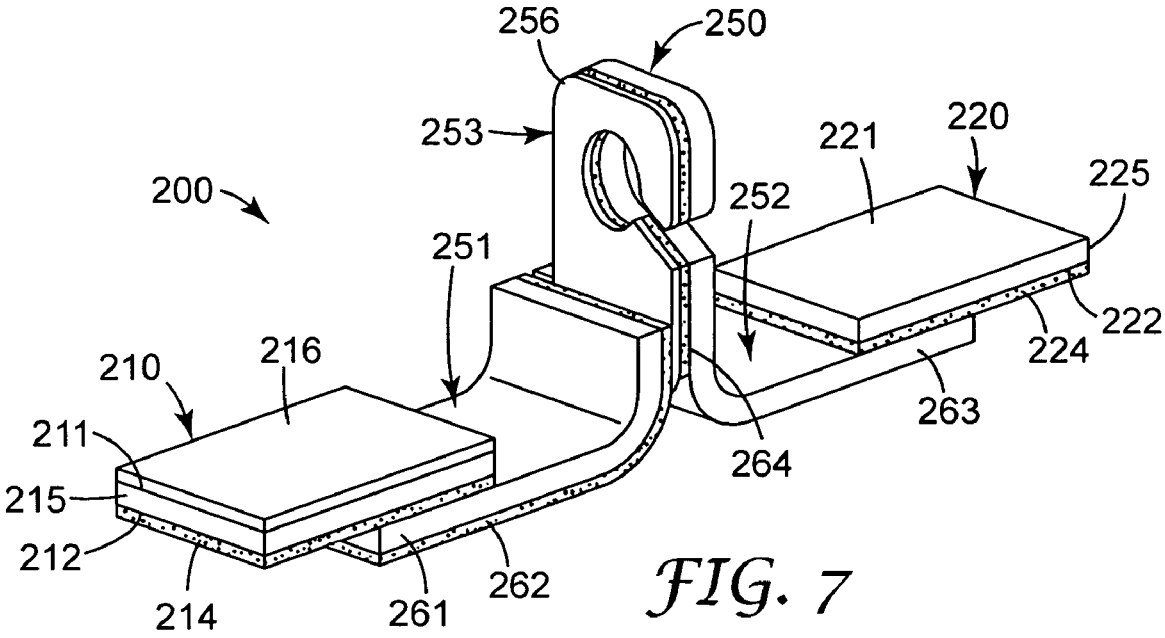
FIG. 7 illustrates an exemplary hanger label according to some embodiments of the present disclosure.

Referring to FIG. 7, another exemplary hanger label 200 according to some embodiments of the present disclosure is shown in an extended position for clarity. Hanger label 200 includes hanger 250 connecting first label segment 210 to second label segment 220. First label segment 210 comprises first adhesive layer 214 directly bonded to second major surface 212 of first substrate 215. In some embodiments, a primer may be used such that the adhesive layer would be indirectly bonded to the surface. As shown, first label segment 210 also includes an optional layer 216 on first major surface 211 of the first substrate. In some embodiments, layer 216 may be a release layer and/or a print receptive layer.

Second label segment 220 includes second adhesive layer 224 bonded to second major surface 222 of second substrate 225. Although not shown, optional layers may be present on first major surface 221 and/or interposed between the second major surface and the adhesive layer. In some embodiments, second indicia may be associated with the first major surface of the second substrate.

Hanger 250 connects first label segment 210 to second label segment 220. Hanger 250 comprises three portions, hook 253, first connection 251, and second connection 252. In this embodiment, the three portions of hanger 250 are discrete parts that are connected to each other. First label segment 210 and second label segment 220 are also discrete parts connected to first connection 251 and second connection 252, respectively. In some embodiments, two or more adjacent elements may comprise sections of a common part, e.g., a common substrate or adhesive layer. In such embodiments, the precise boundary between individual elements may be difficult to ascertain.

First connection 251 includes substrate 261 connecting hook 253 to first label segment 210. In this embodiment, substrate 261 is shown adhered to first label segment 210 via first adhesive layer 214. Hook element 256 is then adhered to adhesive layer 262. In the embodiment shown, adhesive layer 262 extends along the entire length of first substrate 261 of first connection 251.

The same type attachment may be used with the second connection. However, in some embodiments, adhesive layer 262 may be present at only selected locations along the length of the first substrate, e.g., only in the region of first substrate 251 that is bonded to hook element 256. For example, as shown in FIG. 7, an alternative type of connection that may be used in some embodiments is shown with respect to second connection 252. Here, substrate 263 of second connection 252 is adhered to second label segment 220 via second adhesive layer 224. Hook element 256 is bonded to substrate 263 via adhesive layer 264, which is only present in the bonded region.

As also illustrated in FIG. 7, the substrate forming a connection may be bonded to only a portion of hook element 256, as illustrated by first connection 251, or it may be bonded up to the full length of hook element 256, as illustrated by second connection 252. In either case, hook 253 comprises hook element 256 and those portions of substrates 261 and 263 that are adhered to hook element 256.

Although a hanger may be formed from two or more discrete parts, in some embodiments, the hanger is a unitary hanger, i.e., all three portions are integrally connected. With a unitary hanger, there may not be a clear demarcation between the first connection and/or the second connection relative to the hook. In such embodiments, the boundary between the portions is somewhat arbitrary.

Figure 8:
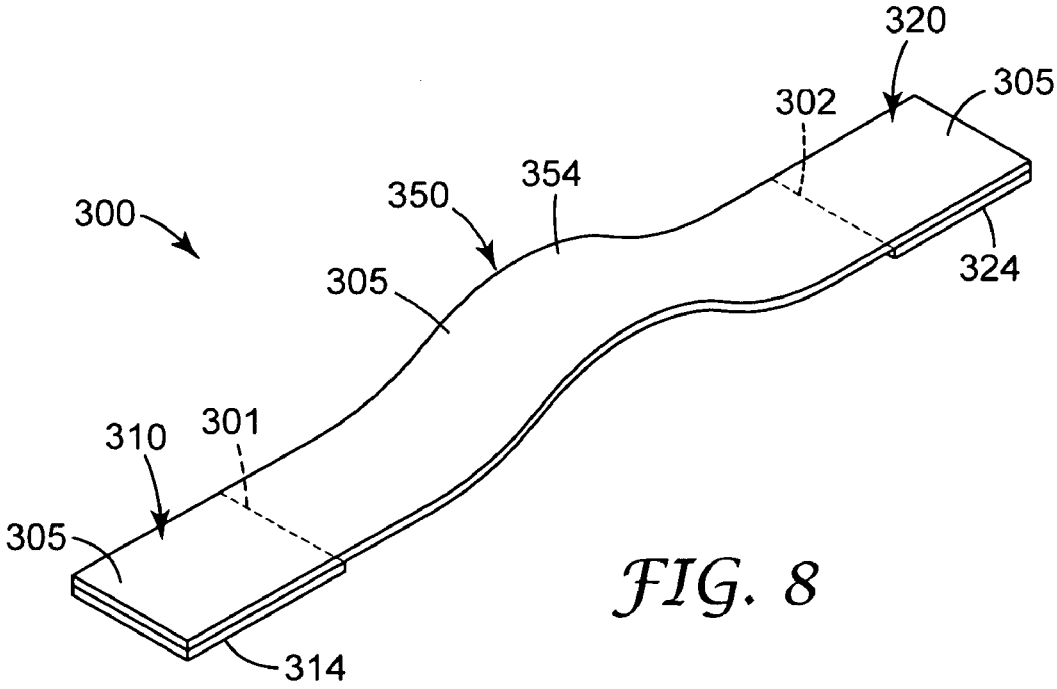
FIG. 8 illustrates another exemplary integral hanger label according to some embodiments of the present disclosure.

Referring to FIG. 8, alternative, exemplary unitary hanger label 300, according to some embodiments of the present disclosure is shown. Unitary hanger label 300 includes first label segment 310, second label segment 320 and hanger 350. Common substrate 305 forms a part of first label segment 310, hanger 350, and second label segment 320.

In contrast to the hanger labels discussed previously, hanger label 300 does not include a hook. Rather, hanger 350 comprises strap 354, which connects first label segment 310 to second label segment 320. As shown in FIG. 8, in some embodiments, the strap may be a single element; however, in some embodiments, the strap may be composed of multiple elements connected to each other by, e.g., adhesives. Generally, strap 354 serves the same functions as the hook of other embodiments discussed herein. That is, when hanger label 300 is in its attached position (i.e., both the first and second label segment are attached to the container), strap 354 is available to suspend the container. In some embodiments, the strap may be passed around a support prior to adhering the second label segment to the container. In some embodiments, the second label segment may be adhered to the container prior to suspending the container from a support by the strap.

First label segment further comprises first adhesive layer 314, and the boundary between first label segment 310 and strap 354 is defined by line 301, which corresponds to the edge of the first adhesive layer. Thus, first label segment 310 includes a portion of substrate 305 and first adhesive layer 314. Similarly, second label segment 320 includes a portion of substrate 305 and second adhesive layer 324. The boundary between second label segment 320 and strap 354 is defined by line 302, which coincides with the edge of the second adhesive layer.

In FIG. 8, adhesive layers 314 and 324 are shown as discrete regions associated with first label segment 310 and second label segment 320. In some embodiments, an adhesive layer may extend up to the full length of substrate 305. In some embodiments, a protective layer, e.g., a release liner may be used to cover portions of the adhesive layer, for example from line 301 to line 302. Exemplary protective layers and release liners include those previously described herein.

As described herein, indicia may be associated with either one or both of the first and second label segments. In some embodiments, indicia may be associated with any surface of any of the elements of the hanger labels of the present disclosure. For example, indicia may be associated with the first connection, the second connection, the hook, or any combination thereof. In some embodiments, it may be desirable to associate indicia with any of the various release liners and protective layers described herein.

Generally, any desired indicia may be selected including, e.g., text, numbers, pictograms, pictures, images, patterns, and the like. Combinations of indicia may also be used. The indicia may be decorative, and/or may provide information, e.g., product identification, directions, warnings, manufacturer and distributor information and the like.

Figure 9A:
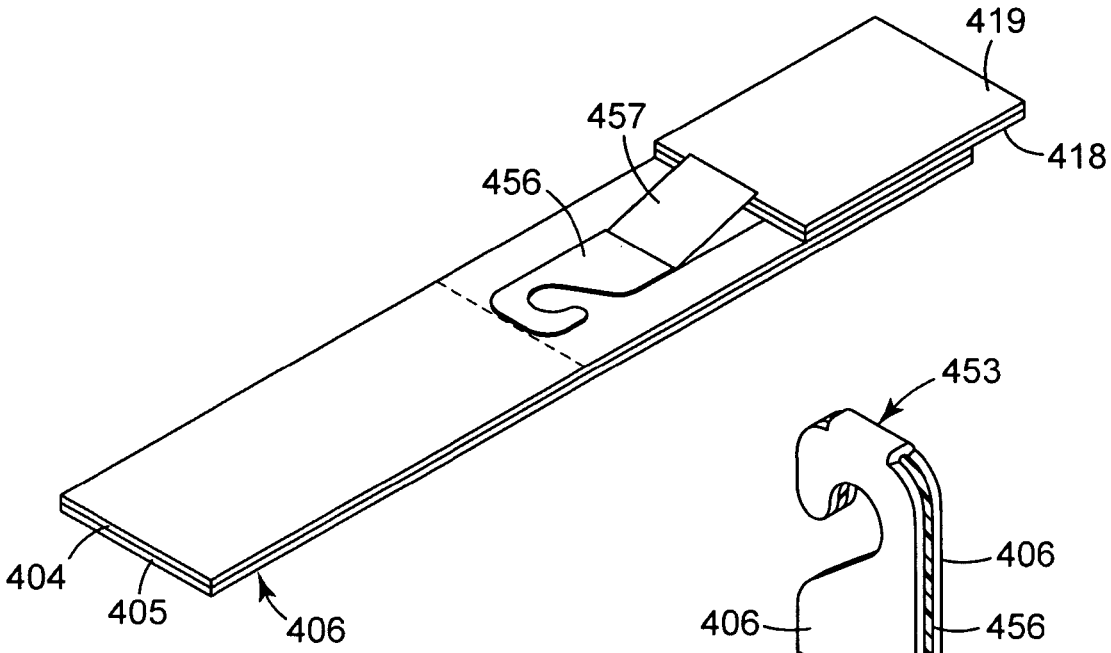
FIG. 9*a* illustrates one step in one exemplary method of making a hanger label according to some embodiments of the present disclosure.
Figure 9B:
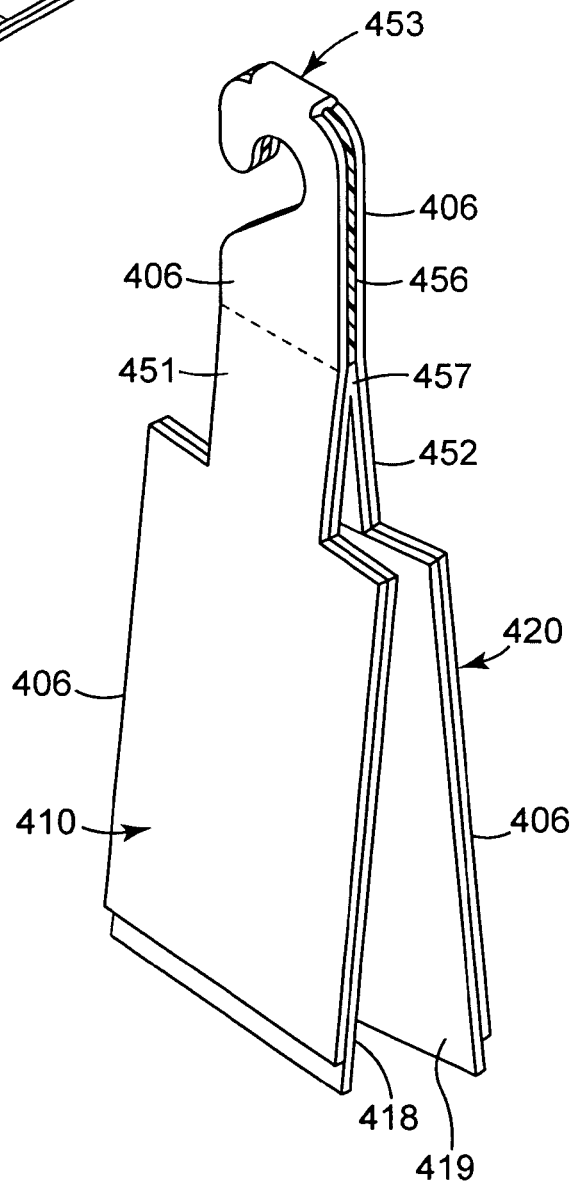
FIG. 9*b* illustrates another step in one exemplary method of making a hanger label according to some embodiments of the present disclosure.
Figure 9C:
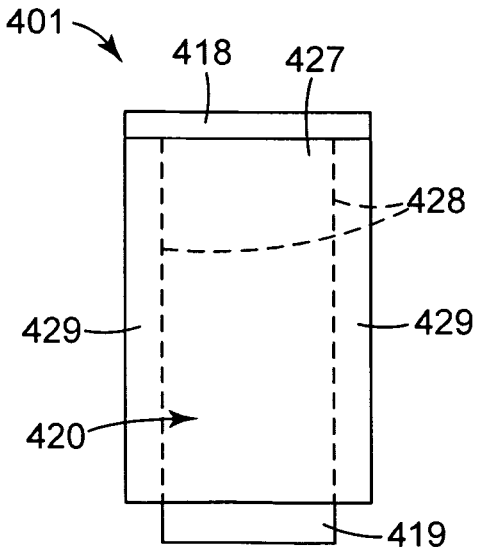
FIG. 9*c* illustrates yet another step in one exemplary method of making a hanger label according to some embodiments of the present disclosure.

A hanger label similar to that depicted in FIG. 2 was constructed according to the following exemplary steps illustrated in FIGS. 9*a*-9*c*.

A piece of label stock (Product No. 7860, available from 3M Company, St. Paul, Minn.) was cut to a length of 30 centimeters (cm) and a width of 7.6 cm. Product No. 7860 includes a 51 micrometer thick white polyester substrate with a gloss, thermal transfer printable top coat on one major surface. An acrylic adhesive is located on the opposite major surface, protected by a silicone-coated paper release liner.

Referring to FIG. 9*a*, the silicone coated release liner was removed from adhesive layer 404 and retained for later use. Label stock 406 was place on a table with adhesive layer 404 surface facing up, and gloss coated polyester substrate 405 facing down. Hook element 456 was then centered across the width of substrate 406 and adhered to adhesive layer 404 with the top of hook element 456 positioned even with the center of the length of the label stock. The length of hook element 406 was 4 cm, so that 15 centimeters of the substrate extended above the top of hook element 456, while 11 cm of the substrate extended below the bottom of the hook element. Hook element 456 was 3.2 cm wide, such that 2.2 cm of the substrate extended from each side of the hook.

Protective layer 457 was formed by cutting a piece of paper to a length of 7.6 cm and a width of 3.2 cm. The paper was folded in half lengthwise, and adhered to adhesive layer 404 directly below the bottom edge of hook element 456. The silicone coated release liner previously removed from label stock 406 was trimmer to provide two release liners, 418 and 419. Release liner 418 was positioned with its silicone coated side facing down and in contact with adhesive layer 404. Release liner 419 was positioned on top of release liner 418, with its silicone coated side facing up. Both release liners were trimmed to length to provide a tab extending approximately one centimeter past the end of label stock 406.

Referring to FIG. 9*b*, the top portion of label stock 406 was folded back upon itself to tightly wrap hook element 456. Resulting hook 453 includes hook element 456 and the portions of label stock 406 adhered to it. Label stock 406 was cut to follow the contours of hook element 456 and protective layer 457. The portions of label stock 406 extending below hook element 456 were trimmed to a width of 5 centimeters forming first label segment 410 and second label segment 420. Liners 418 and 419 were also trimmed to a width of 5 cm. The portion of label stock 406 extending from the bottom of hook element 456 to the beginning of first label segment 410 corresponds to first connection 451. Similarly, the portion of label stock 406 extending from the bottom of hook element 456 to the beginning of second label segment 420 corresponds to second connection 452.

Referring to FIG. 9*c*, the resulting structure was folded to form hanger label 401. Details of the folding are exemplified in FIGS. 1*a*, 1*c*, and 1*d*. A perforating knife was used to form weakened lines 428 in second label segment 420, forming edges 429 and center portion 427. The portions of both release liners located between the first label segment and the second label segment were removed along edges 429. Second label segment 420 was then adhered to the first label segment along edges 429 to form hanger label 401 in its closed position.

In use, release liner 418 is removed from the adhesive side of the fist label segment, and hanger label 401 is adhered to a container, as shown, e.g., in FIG. 1*b*. At some later time, the tab formed by the extension of release liner 419 can be lifted to aid in separating center portion 427 of second label segment 420 from first label segment 410, as shown, e.g., in FIGS. 1*b*-1*d*. Release liner 419 can then be removed and the second label segment can be adhered to the container, as shown, e.g., in FIG. 1*e*.

Various modifications and alterations of this invention will become apparent to those skilled in the art without departing from the scope and spirit of this invention.

Terms such as "label segment" and "connection" are used throughout the specification. The following table summarizes the relationship between these terms and the art recognized terminology used in claims. For each of the terms identified in the Table, the terms used in the claims are equivalent in meaning and scope to the terms used in the specification.

TABLE

Correspondence of terminology.

| Specification | Claims |
|---|---|
| first label segment | first flap |
| second label segment | second flap |
| first connection | third flap |
| second connection | fourth flap |
| hook | hook flap |

What is claimed is:

1. A hanger label comprising a first flap comprising a first substrate having a first major surface and an opposite second major surface, and a first adhesive layer bonded to at least a portion of the second major surface of the first substrate;

a second flap comprising a second substrate having a first major surface and a second major surface, and a second adhesive layer bonded to at least a portion of the second major surface of the second substrate; and a hanger comprising a third flap, a forth flap, and a hook flap; wherein the third flap is connected to the first flap, the fourth flap and the hook flap;

the fourth flap is connected to the second flap, the third flap, and the hook flap; and the hook flap is connected to and extends from both the third flap and the forth flap;

wherein there is, an about 180 degree first fold between the first flap and the third flap;

an about 180 degree second fold between the third flap and the fourth flap; and an about 180 degree third fold between the second flap and the fourth flap and wherein the hook flap is sandwiched between the first flap and the second flap.

2. The hanger label of claim 1, wherein, at least a portion of the second adhesive layer is adhered to the first major surface of the first substrate.

3. The hanger label of claim 2, wherein the portion of the second adhesive layer that is adhered to the first major surface of the first substrate is releasably adhered to the first major surface of the first substrate.

4. The hanger label of claim 1, wherein the second flap comprises a first portion of the second adhesive layer adhered to the first substrate defining a first edge of the second substrate, a second portion of the second adhesive layer adhered to the first substrate defining a second edge of the second substrate, and a center portion positioned between the first edge and the second edge.

5. The hanger label of claim 4, wherein the center portion is separated from the first edge by a first weakened line of the second substrate.

6. The hanger label of claim 4, further comprising a protective layer adjacent the center portion of the second flap.

7. The hanger label of claim 1, wherein the hanger label is an integral hanger label.

8. The hanger label of claim 1, wherein the third flap adhered to the first flap.

9. The hanger label of claim 1, further comprising first indicia on the first surface of the first substrate, and second indicia on the first surface of the second substrate.

10. The hanger label of claim 1, wherein the hook flap comprises a hook element.

11. The hanger label of claim 1, wherein at least one of first flap and the second flap further comprises a tab.

12. A labeled container comprising a container comprising a first exterior surface; and the hanger label of claim 1, wherein at least a portion of the first adhesive layer adheres the hanger label to the first exterior surface of the container.

13. The labeled container of claim 12, wherein, the second flap comprises a first portion of the second adhesive layer adhered to the first substrate defining a first edge of the second substrate, a second portion of the second adhesive layer adhered to the first substrate defining a second edge of the second substrate, and a center portion positioned between the first edge and the second edge.

14. The labeled container of claim 12, wherein at least a portion of the second adhesive layer is adhered to the exterior surface of the container.

* * * * *

UNITED STATES PATENT AND TRADEMARK OFFICE

CERTIFICATE OF CORRECTION

PATENT NO. : 7,762,398 B2
APPLICATION NO. : 12/054046
DATED : July 27, 2010
INVENTOR(S) : Vicki L Tokie It is certified that error appears in the above-identified patent and that said Letters Patent is hereby corrected as shown below:

Column 14

Line 66, in claim 8, after "flap" insert -- is --.

Signed and Sealed this
Twelfth Day of April, 2011

David J. Kappos

David J. Kappos
*Director of the United States Patent and Trademark Office*